US008413361B2

(12) United States Patent
Quaedpeerds et al.

(10) Patent No.: US 8,413,361 B2
(45) Date of Patent: Apr. 9, 2013

(54) SHOULDER FIRE ARM

(75) Inventors: Eric Quaedpeerds, Bassenge (BE); Alain Botty, Ayeneox (BE); Thierry Dumortier, Hermee (BE)

(73) Assignee: Browning International SA, Herstal (BE)

( * ) Notice: Subject to any disclaimer, the term of this patent is extended or adjusted under 35 U.S.C. 154(b) by 171 days.

(21) Appl. No.: 12/761,116

(22) Filed: Apr. 15, 2010

(65) Prior Publication Data

US 2010/0281727 A1 Nov. 11, 2010

(30) Foreign Application Priority Data

May 8, 2009 (BE) ..... 2009/0294

(51) Int. Cl.
*F41C 23/06* (2006.01)

(52) U.S. Cl.
USPC ..... 42/1.06; 42/71.01; 42/74

(58) Field of Classification Search ..... 42/1.06, 42/71.01, 73, 74; 89/158
See application file for complete search history.

(56) References Cited

U.S. PATENT DOCUMENTS 837,601 A * 12/1906 Behr ..... 42/74
1,454,973 A * 5/1923 Malloy, Jr. ..... 188/282.7
2,721,074 A * 10/1955 Bourcier de Carbon .. 267/64.15
2,738,036 A * 3/1956 Crabtree ..... 188/315
2,780,144 A 2/1957 Parrish
2,952,088 A * 9/1960 Ivy ..... 42/16
3,233,354 A * 2/1966 Ahearn ..... 42/74
3,300,889 A 1/1967 Baker
3,381,405 A * 5/1968 Edwards ..... 42/74
3,405,470 A * 10/1968 Wesemann ..... 42/74
3,408,062 A 10/1968 Baker
3,461,589 A * 8/1969 Vironda ..... 42/74
3,707,797 A * 1/1973 Ruth ..... 42/74
4,112,605 A * 9/1978 Staub ..... 42/1.06
4,279,091 A * 7/1981 Edwards ..... 42/1.06
4,439,943 A * 4/1984 Brakhage ..... 42/74
4,663,877 A * 5/1987 Bragg ..... 42/74
4,778,418 A * 10/1988 Mondek ..... 440/63
4,986,018 A * 1/1991 McDonald, Jr. ..... 42/1.06
5,031,348 A * 7/1991 Carey ..... 42/74
6,481,143 B2 * 11/2002 McCarthy ..... 42/74
2011/0138668 A1 * 6/2011 Thomas ..... 42/1.06

FOREIGN PATENT DOCUMENTS

RU 2294507 2/2007

* cited by examiner

*Primary Examiner* — Bret Hayes
*Assistant Examiner* — Joshua Freeman

(57) ABSTRACT

Shoulder fire arm comprising a frame a barrel and a stock for holding the weapon against the shoulder and or the cheek of the gunman wherein the stock is formed of a body and a recoil pad at the end of this body, the recoil pad being connected to the body of the stock by means of a shock absorber and the absorber is placed in such a way that during the shot the stock moves down from the shoulder and cheek of the gunman.

14 Claims, 7 Drawing Sheets

SHOULDER FIRE ARM

BACKGROUND OF THE INVENTION

1. Field of the Invention

The invention concerns an improved fire arm of the shoulder gun type.

2. Discussion of the Related Art

This type of weapon comprises in general a frame, a barrel and a stock for pushing the weapon against the shoulder and/or cheek of the gunman.

A disadvantage of this type of weapon is that at the time of shooting, the shoulder and cheek of the gunman undergo a kick as a consequence of the recoil and raising of the weapon.

This kick varies depending on the type of ammunition used and the weight of the weapon.

The lighter the weapon and the more powerful the ammunition, the stronger the kick to the shoulder of the gunman will be.

In order to provide some comfort during a shot, it is known to use different systems of absorption, such as supple protections placed on the stock, known as a recoil pad or in the shape of foam or other material protection placed directly on the clothes.

It is also known, such as for example in U.S. Pat. No. 4,439,943 and U.S. Pat. No. 837,601, to use horizontally placed hydraulic systems to absorb the recoil, but these are complicated to manufacture and still produce a noticeable kick.

Another disadvantage of the known systems is that, even though they absorb the recoil, they also slow down the re-establishment of the stable configuration of the weapon.

There is thus a need for a gun which has a reduced repercussion of shooting on the shoulder and the cheek in order to give increased comfort to the gunman, and at the same time with a simplified absorption system.

There is also a need for gun that restores itself faster to its stable configuration for the next shot.

SUMMARY OF THE INVENTION

The object of the invention is therefore a fire arm of which the stock is formed of a body and a recoil pad for pushing the weapon against the shoulder of the gunman at the rear end of the body of the stock, this recoil pad being fixed to the body of the stock by means of a shock absorber consisting of a cylinder and a piston mounted in a sliding fashion in the axial direction in the cylinder, integrally connected to a rod which extends partially outside the absorber, the rod being connected to respectively the recoil pad or the body of the stock and the cylinder being connected to respectively the body of the stock or the recoil pad, the absorber comprising two oil-filled chambers which are internally connected by a calibrated passage and of which the volume of one chamber decreases under the influence of a movement of the piston while the volume of the other chamber increases, and which firearm comprises a return spring which, in rest, works directly or indirectly on the recoil pad so as to move it away from the body of the stock over a certain distance and which absorber is placed so that the stock has a tendency to move down from the shoulder and the cheek of the gunman during a shot.

An advantage of the system is that the shock, caused by the shot, is absorbed at least partly in the shock absorber, so that during the shot the body of the stock kicks back and moves closer to the recoil pad while moving the piston of the absorber, which makes the oil pass from one chamber of the absorber to the other chamber through the calibrated passage in the piston, which forms a controlled restriction for the kick of the weapon.

Another advantage is that the reactive forces created by the shock of the shot have a tendency to move the stock down the shoulder and away from the cheek of the gunman which gives the gunman an even softer feeling of the kick. This mechanism works irrespective of the type of mechanism of the gun.

This is preferably realized by positioning the absorber in such a way that the axis of the absorber forms an angle with the axis of the barrel, this angle pointing downward or in such a way that the axis of the absorber forms an angle with the base of the recoil pad facing the foot of the body of the stock.

The oil flow passage is preferably formed by a metering jet limiting the flow of oil in a predetermined manner.

According to a preferred embodiment the two oil chambers are additionally connected by a second passage in which a one-way valve is situated, this passage allowing a larger flow compared to the first passage.

An advantage of the one-way valve is that the influence of the calibrated passage mainly manifests itself in the recoil phase during a shot and is mainly eliminated when the recoil pad retakes its stable configuration under the influence of the return spring.

This causes the gun to regain its neutral configuration faster for the next shot.

For increased clarity, some illustrative and non-limiting examples of how to obtain a firearm according to the invention are described below, referring to the figures.

DESCRIPTION OF THE PREFERRED EMBODIMENTS

Figure 1:
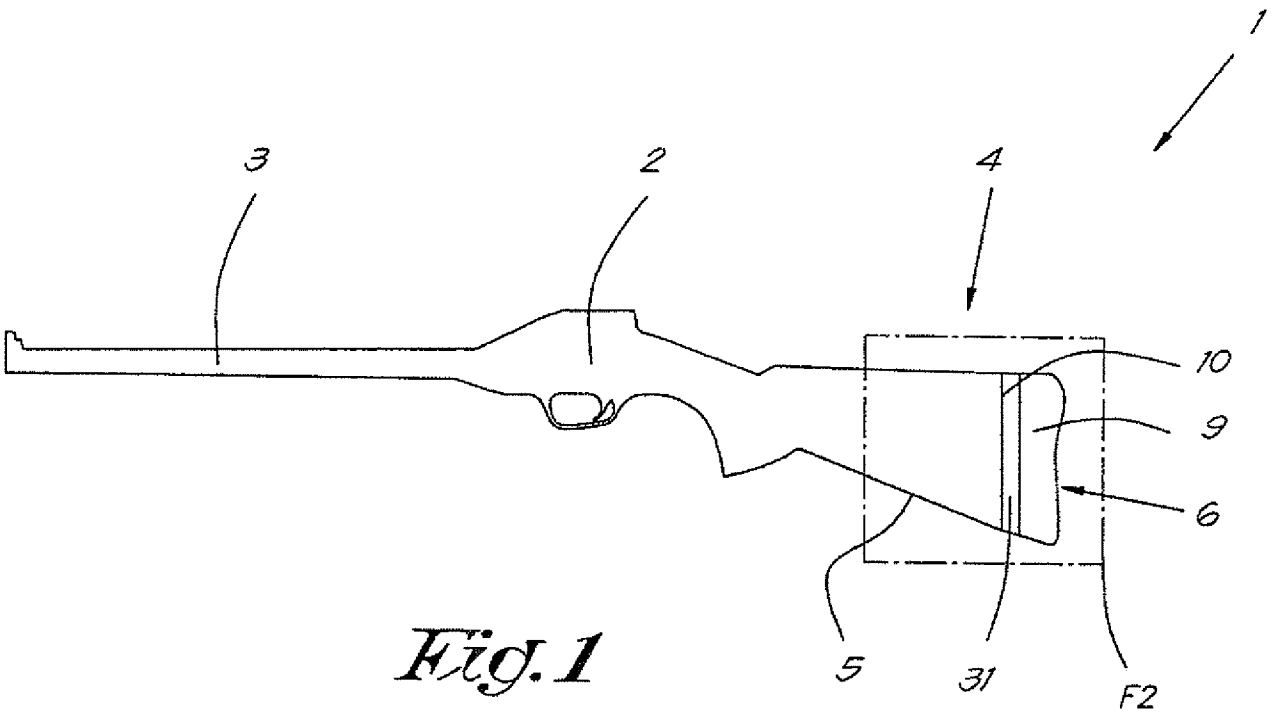
FIG. 1 represents a schematic side view of a fire arm according to the invention.

The fire arm 1 represented in FIG. 1 comprises a frame 2, a barrel 3 and a stock 4, which comprises a body 5 and a recoil pad 6 which is fixed to the body of the stock by means of a shock absorber 7.

The recoil pad 6, at the rear end of the weapon 1 comprises a support plate 8 and a supple layer 9, allowing the absorption of part of the kick of the weapon 1 during a shot.

This type of recoil pad 6 is generally known but is usually applied directly on the foot of the body of the stock, or possibly via an intermediary support 10.

In the illustrated example, the shock absorber 7 is mounted mainly in a hollow of the body of the stock 5 and consists of a cylinder 11 which is closed on each side by stoppers 12, 13 respectively, and comprises a piston 14 installed in a sliding manner in the axial direction X-X' in the cylinder 11 integrally connected to a rod 15 extending partly on each side out of the absorber through a hole in each of the stoppers 12 and 13.

The piston 14 is a simple piston in the present case with a single piston dividing the internal compartment 16 of the cylinder 11 into two closed chambers 17 and 18 respectively, which are linked by an internal passage 19 in the piston 14, the passage 19 being metered by a jet 20 having a calibrated orifice.

Chambers 17 and 18 are at least partially filled with a medium, preferably hydraulic oil.

The shock absorber 7 is connected to the support 10, which is itself connected to the body of the stock 5, by means of the stopper 12, which to this end has an external thread 22 with which it is screwed into an appropriate thread 22 of the body of the stock 5.

The recoil pad 6 is connected to the shock absorber 7, more specifically by the support plate 8, which is connected by means of a screw 23 to a free end of the rod 15 extending from the foot 10 of the stock 5.

A return spring 24 is provided in the oil chamber which, while in rest, acts indirectly on the recoil pad 6 by means of the piston 14 and the rod 15 in such a way as to move it away to a certain distance D from the stock. This distance is optimized to be around 13 to 14 mm so that the effect is not too pronounced.

The stock 4 is also provided with means to prevent the rotation of the recoil pad 6 on the rod 15 of the shock absorber 7, these means being formed in the present case by a guide 25 installed on the support plate 8 of the recoil pad and extending itself into a hollow in the foot 10 of the body of the stock 5.

The shock absorber 7 is closed off by means of gaskets 26 situated at the points where the rod 15 passes through the stoppers 12 and 13 and at the parts of stoppers 12 and 13 which are inserted into cylinder 11 of the shock absorber 7.

A particular element of the invention is that the shock absorber 7 is positioned in such a way that is, when the recoil pad 6 nears the body of the stock 5, for example by it being pushed under the effect of the recoil of the weapon during a shot, the stock 4 tends to move downward with respect to the recoil pad, which is for example being supported by the shoulder 27 of the gunman in shooting position.

Figure 2:
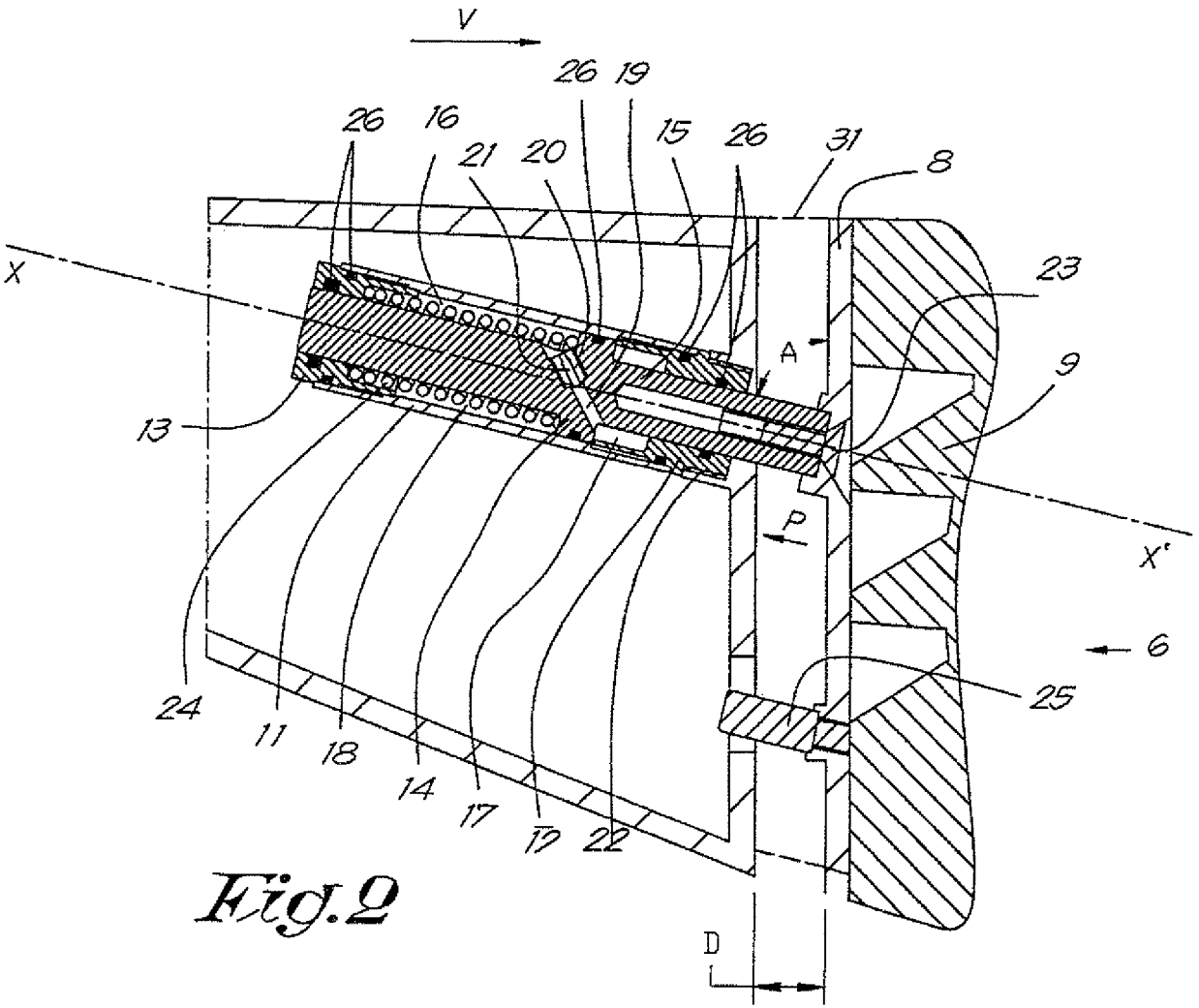
FIG. 2 represents an enlarged cut of the part indicated by F2 in FIG. 1.

This is obtained in the example of FIG. 2 by positioning the absorber 7 in such a way that the axis of the absorber forms an angle with the axis of the barrel 3, preferentially an angle of approximately 13°, the angle being directed downward, and especially that the absorber 7 forms an angle A with the base of the recoil pad 6 on the side facing the foot 10 of the body of the stock 5, so with the support plate 8.

The functioning of the absorption according to the invention is easy and is illustrated as follows by means of FIGS. 2 to 5.

Figure 4:
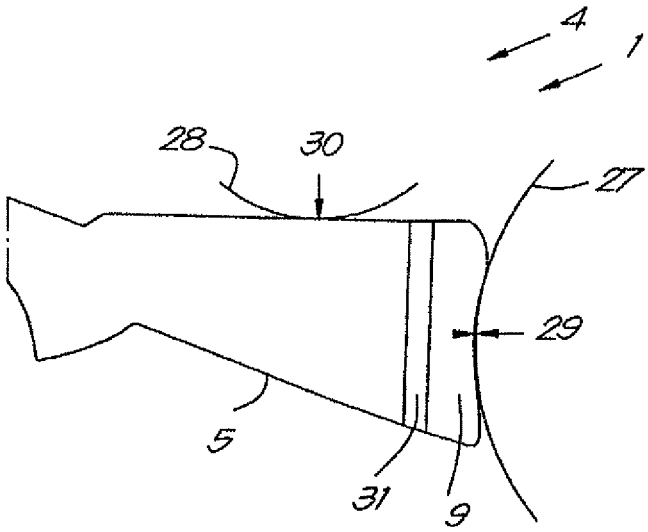
FIG. 4 represents the contact points between the weapon of FIG. 1 and the gunman using the weapon in rest.

To take aim, the firearm is handled in a classic manner by taking it with both hands while pushing the weapon 1 with the recoil pad 6 against the shoulder and pushing the cheek against the stock 4 like shown in FIG. 4 which indicates the contact points 29 and 30 at rest with the shoulder and the cheek.

This situation corresponds to the configuration at rest of the shock absorber 7 as represented in FIG. 2, in which the recoil pad 6 is separated over a distance D from the body of the stock 5 by means of the return spring 24.

During a shot, the weapon 1 and therefore the body of the stock 5 are thrown backward in the direction of arrow V, which induces the body of the stock 5 to approach the recoil pad 6 while the recoil pad 6 is held back by the shoulder 27 of the gunman.

Figure 3:
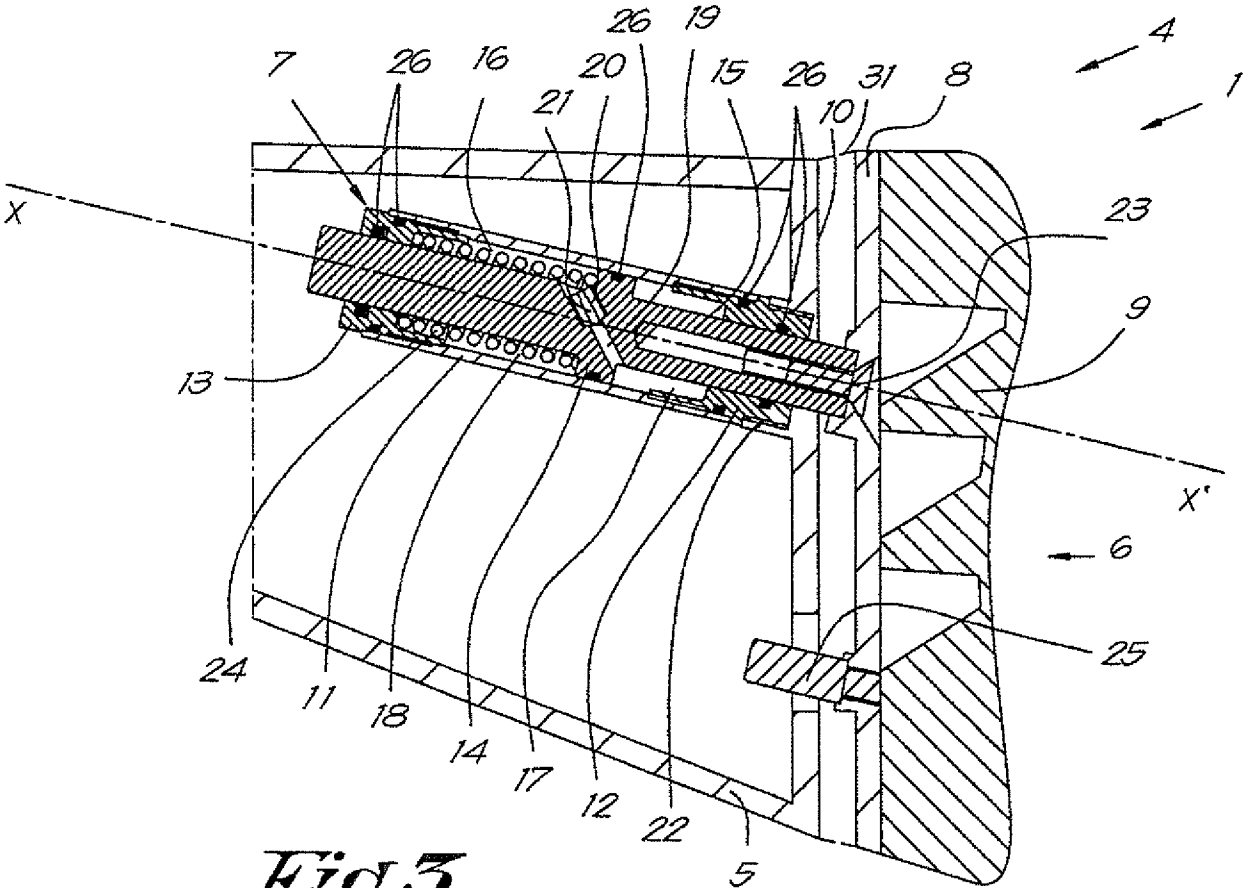
FIG. 3 represents the same view as FIG. 2 but during a shot.

This movement diminished thus the distance D between the body of the stock 5 and the recoil pad 6 as shown in FIG. 3, which forces the rod 15 move into the shock absorber 7 against the action of the return spring 24, while moving the piston 14 in the direction of the arrow P, which reduces the volume of the oil chamber 18 while at the same time increasing the volume of the oil chamber 17.

The oil in chamber 18 is therefore transferred to chamber 17 via the calibrated passage 19 comprising the jet 20.

This way, the kick of the weapon is absorbed by the restricted passage of oil from chamber 18 to the other chamber 19.

The degree of absorption can be selected by choosing a jet 20 with an orifice 21 suited to the needs of the gunman.

Figure 5:
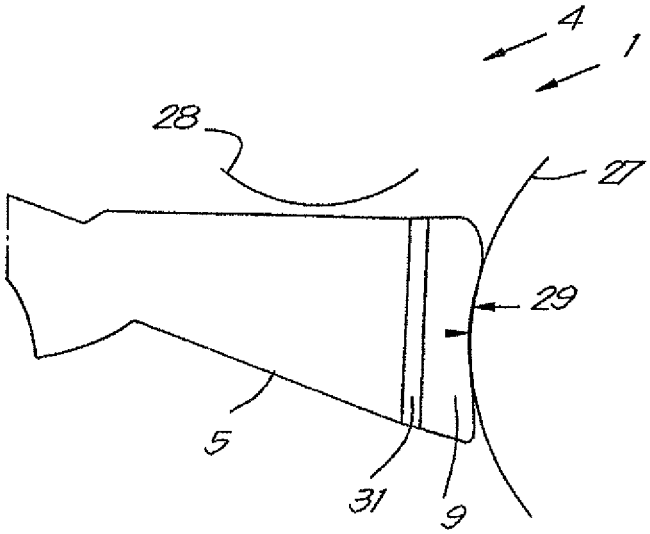
FIG. 5 represents an analogous view to that of FIG. 4 but during a shot.

By means of the positioning of the shock absorber 7 at an angle A with respect to the recoil pad 6, the stock 4 has a tendency to move downward during a shot as shown in FIG. 5 in which it can be seen that the stock 4 has removed itself from the contact point 30 with the cheek 28 and that the recoil pad 6 has moved downward with respect to the initial contact point 29 with shoulder 27 of the gunman.

The kick is also absorbed by the recoil pad which is made so as to be supple, allowing the partial absorption of the kick.

After the shot, the return spring 24 pushes the recoil pad back in order to establish the initial distance D between the recoil pad and the body of the stock 5, in order to return the configuration at rest of FIG. 2.

It is clear that the return spring 24 doesn't necessarily need to be situated at the interior of the shock absorber 7, but that it is also possible, for example, to allow one or more springs 24 to be present between the body of the stock 5 and the recoil pad 6.

It is also obvious that the shock absorber 7 could be mounted inversely, the absorber 7 being connected to the body of the stock 5 by means of the rod 15 and the recoil pad 6 being connected to the absorber 7 by the cylinder 11 or the stoppers 12, 13.

The space between the body of the stock 5 and the recoil pad 6 can optionally be covered by a flexible sleeve 31, for example made in rubber, as represented in dotted lines in FIG. 2.

Figure 6:
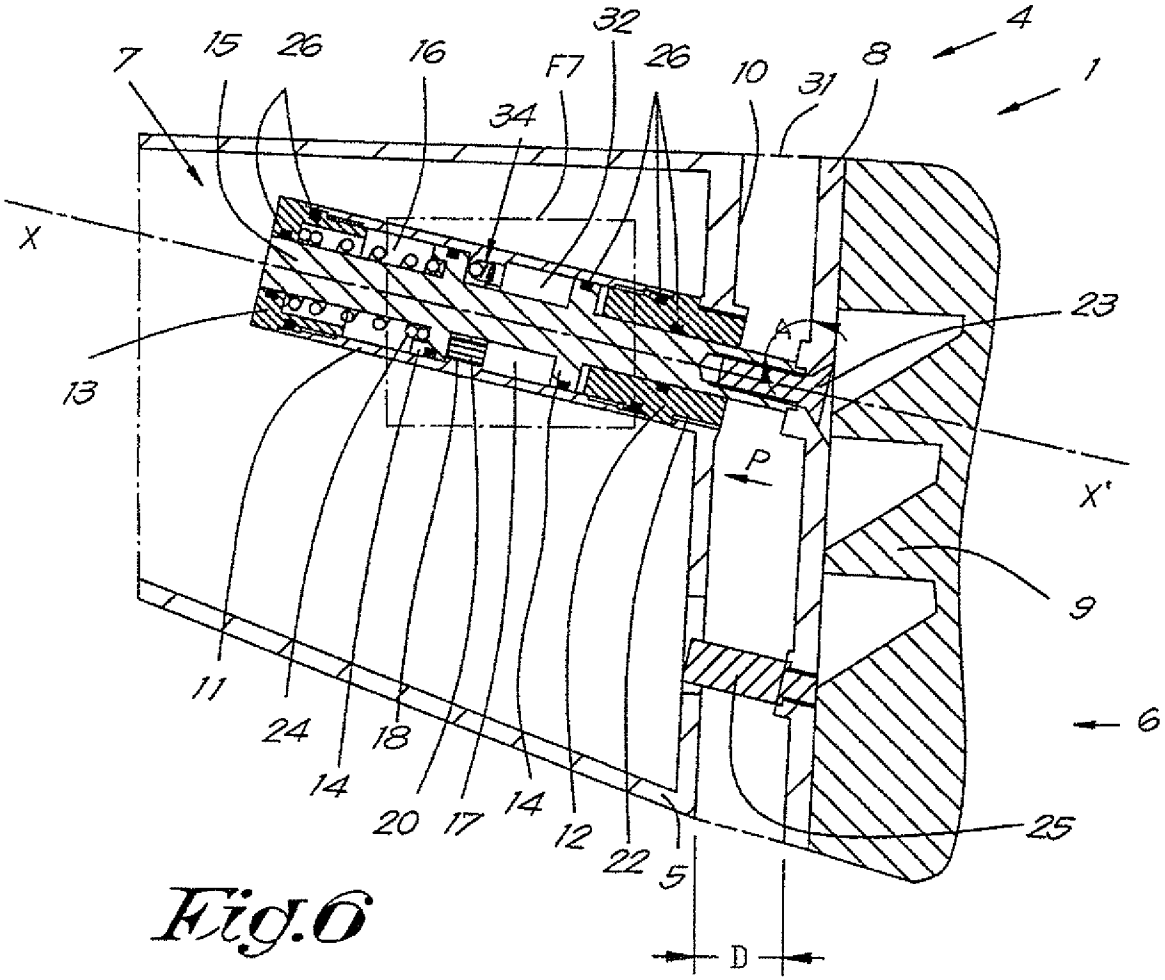
FIG. 6 represents a view as in FIG. 2 but for a variant of a weapon according to the invention.
Figure 7:
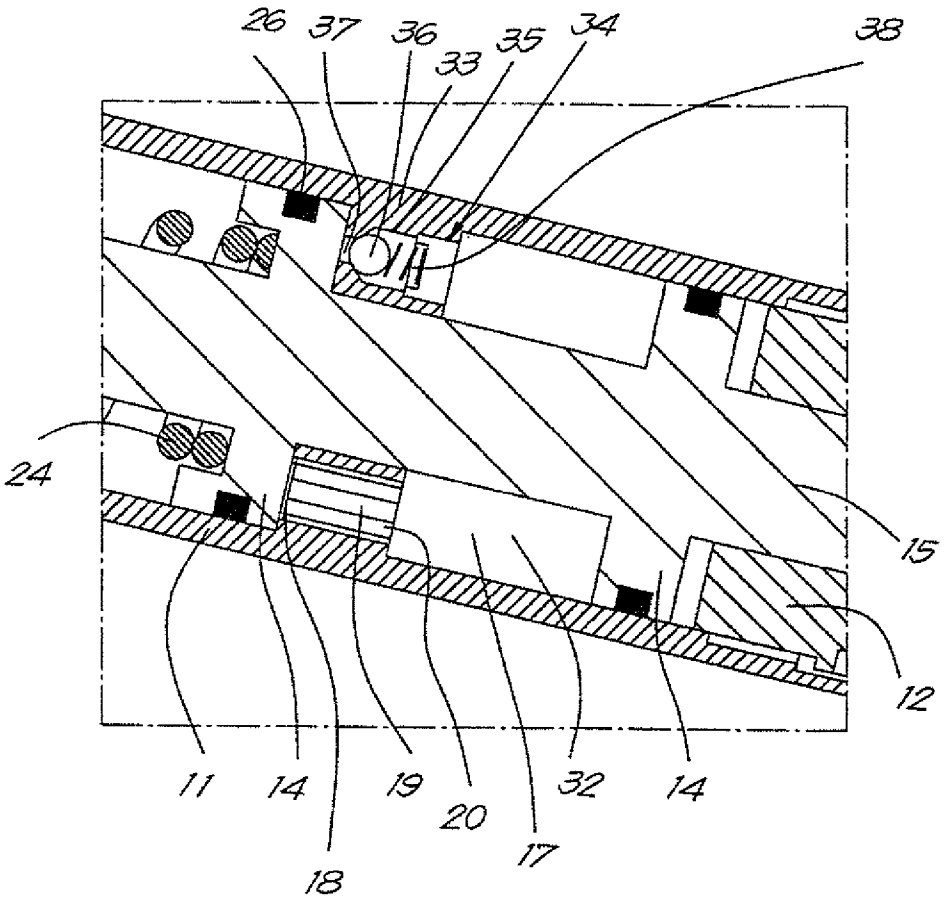
FIG. 7 represents an enlarged view of the part indicated by F7 in FIG. 6

Another embodiment of a firearm according to the invention is represented in FIG. 6, in the configuration at rest.

In this embodiment the shock absorber 7 is made in the form of a double piston with two pistons 4 connected by the rod 15, forming a closed compartment 32 which is divided into two oil chambers, 17 and 18 respectively, by a ring shaped internal neck 33 in the cylinder 11, the chambers 17 and 18 being connected by a first calibrated oil passage in the neck 33.

An additional element is the presence of a one-way valve 34 which is mounted in the neck 33 and which links the two oil chambers 17 and 18 via a second passage 35 in which the one way valve is mounted in the form of a ball 36 which is held against the seat of an orifice 37 under the effect of a non-return spring 38 in order to block the passage 35.

This one-way valve 34 is mounted in such a way that the ball 36 of the one-way valve 34 is pushed towards an open position against the action of the non-return spring when the recoil pad is moved away from the stock 4.

The functioning of this variant is similar to that of the first variant.

Figure 8:
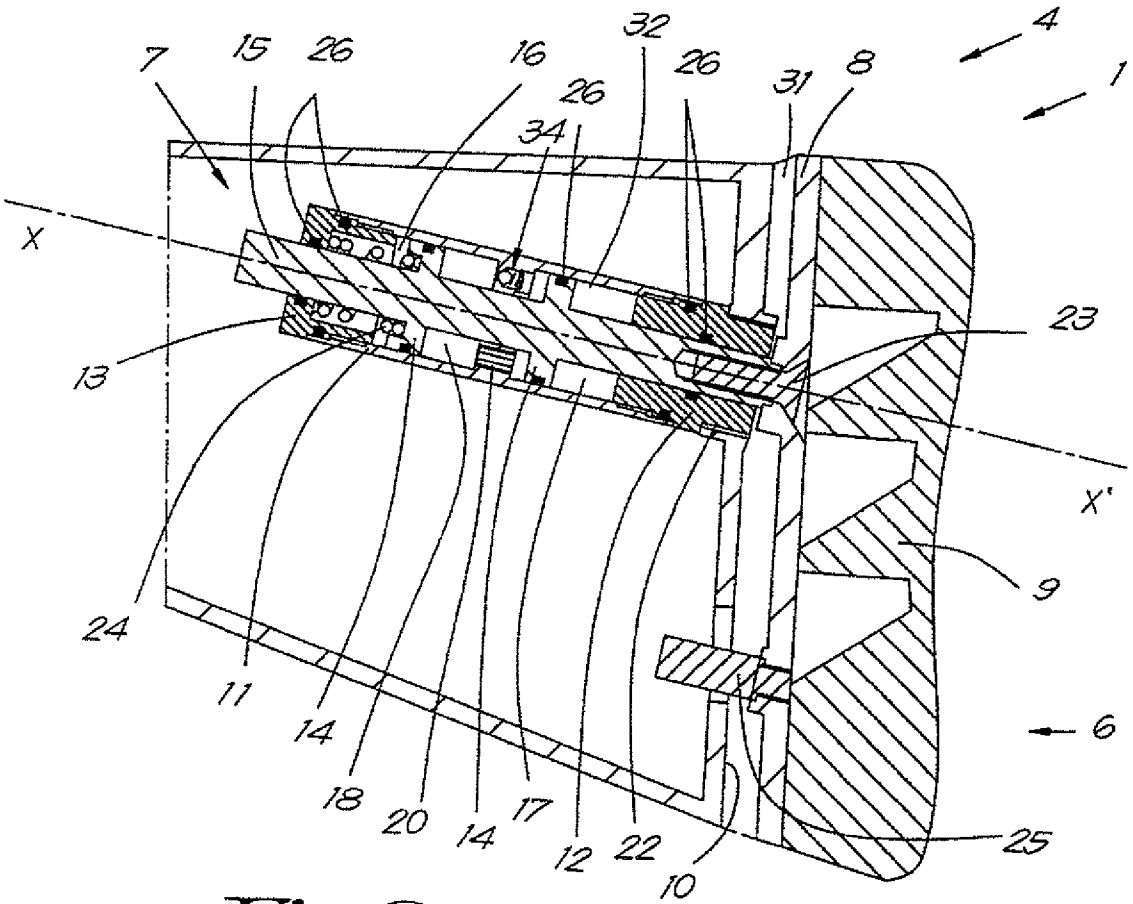
FIG. 8 is the same view as FIG. 6 but during a shot.

If, starting from the situation at rest of FIG. 6, a shot is fired, the double piston moves into the cylinder 11 of the shock absorber 7 as a consequence of the kick, as shown in FIG. 8.

While entering the cylinder 11, the volume of chamber 17 decreases, while the volume of chamber 18 increases simultaneously.

The pressure in chamber 17 increases as a result, forcing the oil to flow from chamber 17 to chamber 18 via passage 19.

The ball 36 of the one way valve 34 is simultaneously firmly pushed against the orifice 37 of the one way valve 34 in order to block the oil passage 35 between chamber 17 and 18.

The oil can therefore only pass through the calibrated passage 19, which produces an absorption of the kick.

After the shot, the double piston is pushed back by the return spring 24 to move the recoil pad 6 away from the body of the stock 5 to the configuration at rest of FIG. 6.

While returning to the configuration at rest, the movement of the double piston reduces the volume of chamber 18 and increases the volume of chamber 17, and increases the pressure in chamber 18.

The pressure in chamber 18 moves the ball 36 away from the seat of the orifice 37 of the one-way valve in order to open the second passage 35 which has a larger diameter than the passage 19 so that a higher flow rate of oil is possible.

The passage 35 forms therefore a preferred passage to move in a faster way the oil in chamber 18 towards chamber 17 even so without forming a significant restriction to the oil transfer.

The repositioning in the configuration at rest of the shock absorber 7 will therefore happen in a much faster way, so that the gun may be ready for the next shot faster.

The indication of direction, such as for example the term move downward are defined relative to a gunman with a weapon in shooting position.

It is obvious that the invention is in no way limited to the examples given above but that numerous modifications can be made to the firearm according to the invention without departing from the framework of the invention such as it is defined in the claims.

The invention claimed is:

1. A firearm comprising:

a frame;

a barrel;

a stock including a body;

a recoil pad; and a hydraulic kick absorption mechanism connecting the recoil pad to the body such that a space is defined between an end wall of the stock and an end wall of the recoil pad adjacent the hydraulic kick absorption mechanism, the hydraulic kick absorption mechanism including a return spring pushing the recoil pad away from the body of the stock when the hydraulic kick absorption mechanism is in a rest position, and enabling the space between the stock and the recoil pad to decrease during discharge of the firearm, the hydraulic kick absorption mechanism further including a shock absorber comprising:

a cylinder connected to one of the recoil pad and the body of the stock;

a piston mounted in a sliding manner within the cylinder;

a rod integrally connected to the piston and partially extending from the shock absorber, wherein the rod is also connected to one of the body of the stock and the recoil pad; and first and second oil chambers within the cylinder, the first and second oil chambers being connected via a first calibrated oil passage such that a volume of oil within the first oil chamber decreases under the effect of the piston while a volume of oil in the second chamber increases; and wherein the shock absorber is positioned within the stock and the stock is positioned with respect to the recoil pad such that, when the recoil pad is positioned against a shoulder of a gunman and a cheek of the gunman is positioned against the stock in a shooting position, and the firearm is discharged by the gunman, the body of the stock has a tendency to move downward with respect to the recoil pad and the shoulder and the cheek of the gunman.

2. The firearm according to claim 1, wherein the shock absorber is placed in such a way that when the body of the stock is pushed towards the recoil pad, the body of the stock moves downward with respect to the recoil pad.

3. The firearm according to claim 1, wherein the shock absorber is placed in such a way that when the body of the stock is pushed towards the recoil pad, the body of the stock moves downward with respect to the recoil pad and an axis of the shock absorber forms a downward angle with an axis of the barrel.

4. The firearm according to claim 1, wherein the shock absorber is placed in such a way that an axis of the shock absorber forms an angle with a base of the recoil pad facing a foot of the body of the stock.

5. The firearm according to claim 1, wherein said first calibrated oil passage is formed by a jet.

6. The firearm according to claim 1, wherein the first and second oil chambers are connected by a second passage in which is provided a one-way valve, said second passage allowing a larger flow rate of oil flow between the first and second oil chambers than said first passage.

7. The firearm according to claim 6, wherein said one-way valve is a valve with a ball which in rest closes the orifice of said second passage by the action of an non-return spring.

8. The firearm according to claim 7, wherein said one-way valve is mounted in such a way that said ball is pushed towards an open position against the action of said non-return spring when said recoil pad is pushed away from the body of the stock.

9. The firearm according to claim 1, wherein said return spring is mounted inside the shock absorber and works on the piston.

10. The firearm according to claim 1, in which the recoil pad comprises a supple layer adapted to absorb energy of a kick caused by a discharge of the firearm.

11. The firearm according to claim 1, wherein the piston of the shock absorber is a single piston which divides an internal compartment of the cylinder into first and second closed oil chambers that are connected by an internal oil passage in the piston.

12. The firearm according to claim 1, wherein the piston of the shock absorber is a double piston connected by a rod and closing off a compartment which is divided into two oil chambers by an internal neck in the cylinder, the two oil chambers being connected by an oil passage in the neck.

13. The firearm according to claim 1, wherein a space between the body of the stock and the recoil pad is covered by a flexible sleeve.

14. The firearm according to claim 1, further comprising:

means for preventing rotation of the recoil pad around the shock absorber.

* * * * *